United States Patent [19]

Sundahl

[11] Patent Number: 4,622,700

[45] Date of Patent: Nov. 18, 1986

[54] SUCTION VENTILATED HELMET

[75] Inventor: James G. Sundahl, Irvine, Calif.

[73] Assignee: Bell Helmets Inc., Norwalk, Calif.

[21] Appl. No.: 806,512

[22] Filed: Dec. 9, 1985

[51] Int. Cl.[4] ..... A42B 3/00

[52] U.S. Cl. ..... 2/425; 2/171.3; 2/412

[58] Field of Search ..... 2/425, 171.3, 412, 184.5

[56] References Cited

U.S. PATENT DOCUMENTS

| | | | |
|---|---|---|---|
| 935,556 | 9/1909 | Smith . | |
| 1,347,046 | 7/1920 | McDonough . | |
| 2,769,176 | 11/1956 | Gransay et al. . | |
| 2,846,683 | 8/1958 | Dye et al. . | |
| 2,991,478 | 7/1961 | Zbikowski . | |
| 3,082,428 | 3/1963 | Zbikowski . | |
| 3,310,811 | 3/1967 | Iacono, Jr. . | |
| 3,344,433 | 10/1967 | Stapenhill . | |
| 3,496,854 | 2/1970 | Feldmann et al. . | |
| 3,783,450 | 1/1974 | O'Connor . | |
| 3,873,997 | 4/1975 | Gooding . | |
| 3,925,821 | 12/1975 | Lewicki . | |
| 4,044,400 | 8/1977 | Lewicki et al. . | |
| 4,054,953 | 10/1977 | DeBarsy | 2/425 X |
| 4,115,874 | 9/1978 | Hasegawa | 2/425 |
| 4,434,514 | 3/1984 | Sundahl et al. | 2/171.3 X |
| 4,555,816 | 12/1985 | Broersma | 2/171.3 X |

*Primary Examiner*—Werner H. Schroeder
*Assistant Examiner*—Andrew M. Falik
*Attorney, Agent, or Firm*—William W. Haefliger

[57] ABSTRACT

A forwardly longitudinally extending cyclist's protective helmet includes a dome shaped outer shell having a forward portion, a rearward portion, and a medial portion over which air flows substantially smoothly as the cyclist moves forwardly. That medial portion includes an upper crown and laterally spaced left and right sides extending downwardly and laterally from the crown. At least one opening is located in the medial portion, the opening facing rearwardly and bounded by elongated outer and inner edges which extend substantially laterally. Air flowing over the medial portion acts to aspirate air from within the helmet interior and outwardly through the opening.

16 Claims, 7 Drawing Figures

SUCTION VENTILATED HELMET

BACKGROUND OF THE INVENTION

This invention relates generally to helmets, and more particularly concerns safety helmets of the type worn by bicyclists and motorcyclists, and having a construction enhancing comfort and safety of the wearer.

In the past, it was known to provide air vents in helmets, as for example are described in U.S. Pat. No. 3,496,854 to Feldman, U.S. Pat. No. 3,925,821 to Lewicki, and U.S. Pat. No. 4,434,514 to Sundahl. A problem associated with these air vents was the admission of undersirable elements such as foreign particles, rain or snow through the ram type forward openings of such helmets. These helmets additionaly lacked the advantageous features of construction, beneficial results and combinations thereof as are now provided by the present helmet, these including enhanced air cooling, perspiration removal, safety and adjustability.

SUMMARY OF THE INVENTION

It is a major object of the invention to provide an improved helmet incorporating all of the above referenced advantages and results. Basically, the helmet comprises:

(a) a dome shaped outer shell having a forward portion, a rearward portion, and a medial portion over which air flows substantially smoothly as the cyclist moves forwardly, said medial portion including an upper crown and laterally spaced left and right sides extending downwardly and laterally from said crown, (b) the outer shell containing at least one opening in said medial portion, said opening facing rearwardly and bounded by elongated outer and inner edges which extend substantially laterally, (c) the shell outer surface being inwardly deflected immediately rearwardly of said inner edge and continuing rearwardly to merge with the dome shape of said outer shell, (d) whereby air flowing over said medial protion acts to aspirate air from within the helmet interior and outwardly through said opening.

It is found that the rearward directing of the vent openings in the medial portion of the helmet provides positive and enhanced air eduction or removal from the helmet from the upper and side interiors of the helmet, air being drawn from many zones in the helmet toward such vent openings; and the elimination of need for ram type vent openings in the front and rear portions of the shell increases the strength of those helmet portions, for greater safety.

As will appear, there may be typically at least two or three such rearward facing openings in the shell medial portion, such openings including a first opening at said upper crown, and additional side openings in said left and right sides of said medial portion and at lower elevations than said one opening; a single vent opening may extend across the top and down opposite sides; and the medial portion of the shell containing all such vent openings is located between two lateral vertical planes respectively spaced about 35% and 75% of the helmet length rearward of the front edge of the helmet.

Further, the helmet may typically include a rigid liner lining the inner side of the outer shell, said liner defining air flow channeling extending generally rearwardly toward said one opening, and also extending generally forwardly toward said one opening thereby to channel air to flow within the helmet interior upwardly and rearwardly toward said outlet, and upwardly and forwardly toward said outlet; the helmet may be channeled to aspirate air flow from the inner side of a face shield, for defogging same.

These and other objects and advantages of the invention, as well as the details of an illustrative embodiment, will be more fully understood from the following specification and drawings, in which:

DRAWING DESCRIPTION

DETAILED DESCRIPTION

Figure 1:
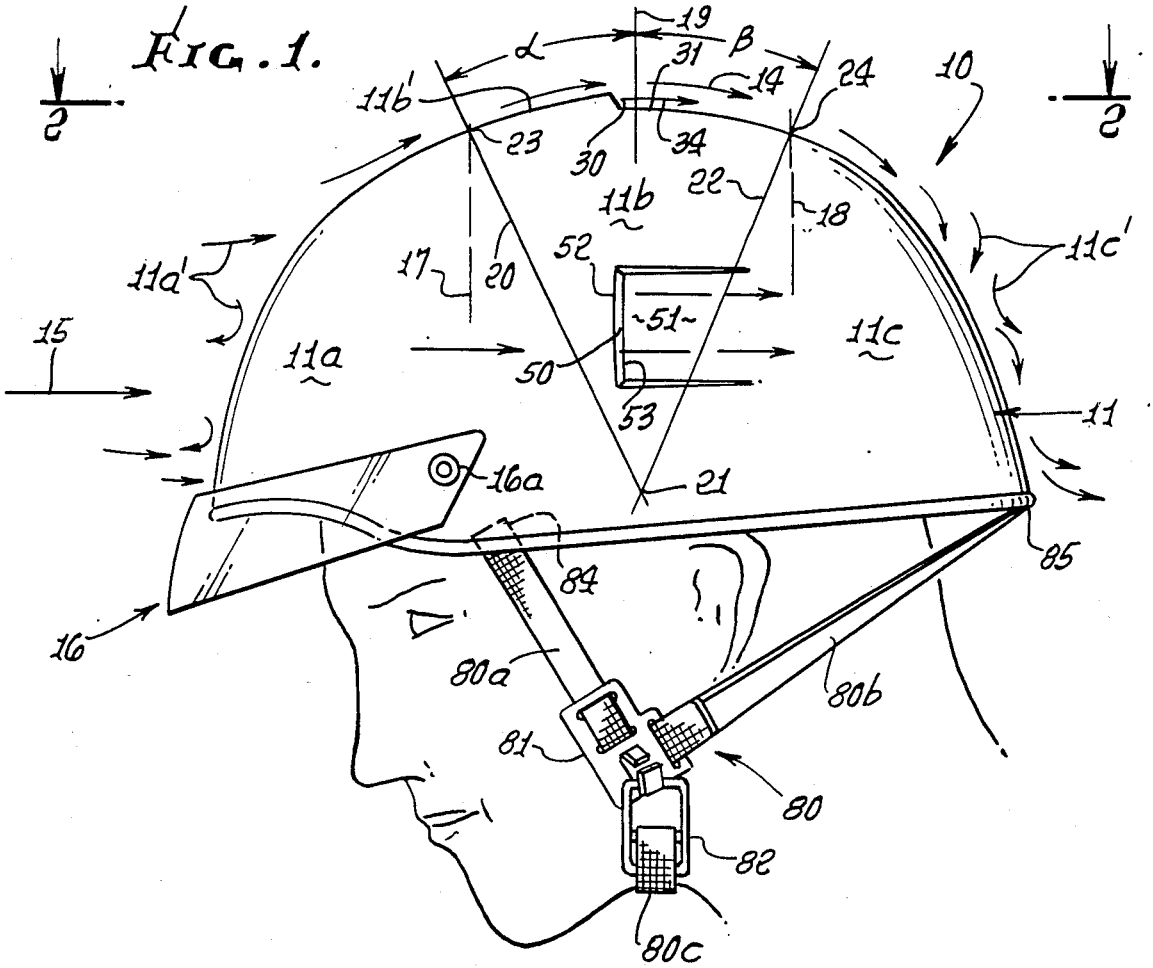
FIG. 1 is a side elevation of a cyclist's helmet incorporating the invention.

In the drawings, the helmet 10 includes an outer, relatively thin, dome-shaped shell 11, and an inner relatively thicker liner 12. The shell consists for example of hard, molded plastic material such as DU PONT ST 801 NYLON, or polycarbonate; and the liner consists for example of semiflexible foam plastic material such as polystyrene or polyurethane.

The shell 11 has a forward portion 11*a*, a rearward portion 11*c* and a medial portion 11*b*. The medial portion is characterized by smooth air flow over the surface 11*b*′, as indicated by arrows 14; the forward portion 11*a* is characterized by non-smooth air flow as indicated by eddy current arrows 11*a*′; and the rear portion 11*c* is also characterized by non-smooth air flow, as indicated by eddy current arrows 11*c*′ close to the shell, these conditions existing at approach relative air flow (see arrow 15) speeds over fifteen miles per hour, for example. The presence of the C-shaped visor 16 offset from the shell also contributes to non-smooth air flow adjacent forward portion 11*a*. The visor ends are pivotally connected to the helmet as at 16*a*, with detect adjustment for visor positions.

Figure 2:
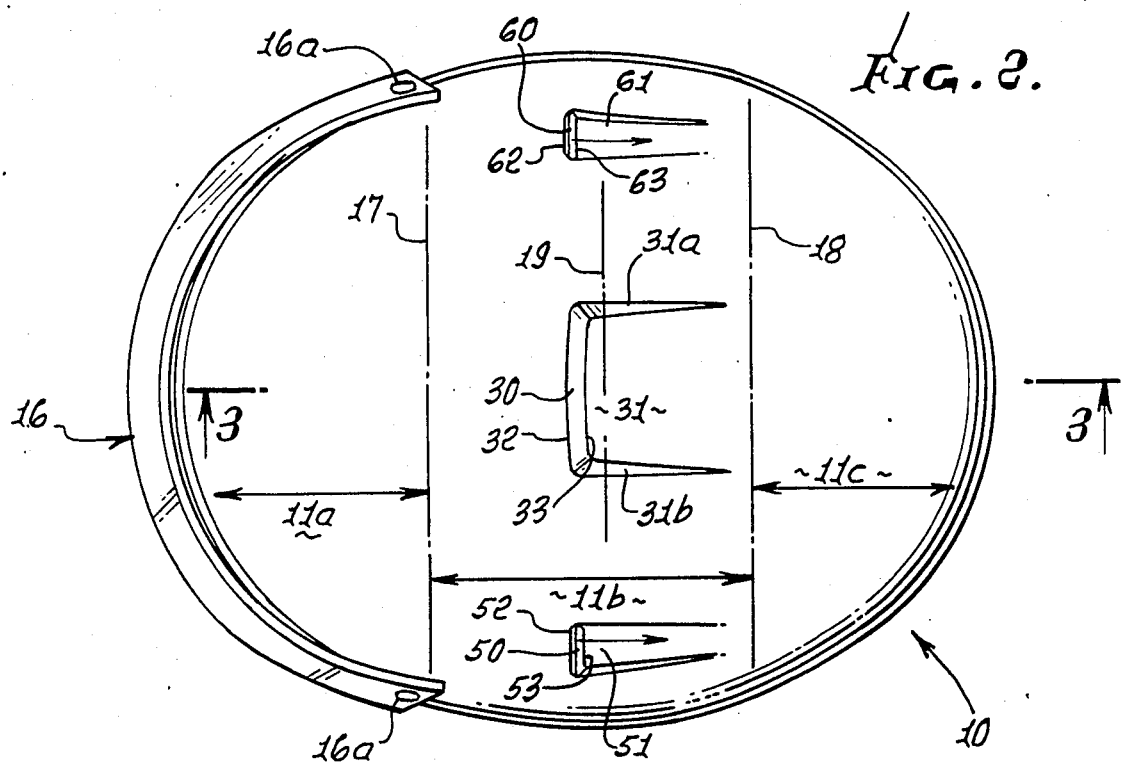
FIG. 2 is a top plan view taken on lines 2—2 of FIG. 1.

In FIG. 2, the forward portion 11*a* is forward of plane 17; the rearward portion 11*c* is rearward of plane 18; and the medial portion is between planes 17 and 18. Those planes are lateral vertical planes through the helmet, and further characterized by the medial portion 11*b* occupying approximately 40% of the helmet length, and forward portion 11*a* occupying approximately 35% of the helmet length, and the rear portion occupying approximately 25% of the helmet length. See also angles $\alpha$ and $\beta$ in FIG. 1, angle $\alpha$ being approximately 15° as measured between a vertical lateral plane 19 bisecting the helmet, lengthwise, and a line 20 from the approximate center 21 of forward and rearward curvature of the shell outer top surface, to the intersection 23 of plane 17 with that surface; and angle $\beta$ being approximately 15° as measured between plane 19 and a line 22 from center 21 to the intersection 24 of plane 18 with the shell outer top surface. Medial portion 11*b* includes an upper crown, intersected by plane 19 for example, and laterally spaced left and right sides extending downwardly and laterally from the crown.

The outer shell contains at least one opening, as at 30, in medial portion 11*b*, that opening or openings facing rearwardly, and the shell outer surface being inwardly deflected, as at 31, immediately rearwardly of the opening and continuing rearwardly to merge with the dome shape of the outer shell. As illustrated, the opening 30 faces rearwardly and is bounded by elongated outer and inner edges 32 and 33 which extend substantially laterally. These edges may be generally parallel to form a laterally extending opening slit therebetween. The shell deflected surface 31 merges sidewardly with the shell outer surface along rearwardly tapering, sloped portions 31*a* and 31*b*. As a result, air flowing over the medial portion (see arrow 14) acts to aspirate or draw air from within the helmet interior and outwardly through the opening 30, as indicated by arrow 34. This effect increases with increasing forward speed of the cyclist. Accordingly, the interior of the helmet is efficiently ventilated, air being drawn from substantially the entirety of the helmet interior toward the one or more backward facing openings (as at 30) in the helmet shell.

Liner 12 also forms a backward or rearward facing opening 35 at the immediately inward side of opening 30, and the liner inner surface is angled outwardly and rearwardly at 36 toward that opening 35. Note that air is drawn within the helmet interior rearwardly (see arrows 37) toward opening 30, and also forwardly (see arrows 38) toward opening 30. This effect is enhanced by the provision of channels or grooves 39 and 40 in the liner, channel 39 extending upwardly and rearwardly toward opening 30, and channel 40 extending upwardly and forwardly toward opening 30. Air in the helmet may enter such channels at any points along their lengths, and such channels are open and unrestricted, as contrasted with air porous padding that may be received in the helmet at the inner side of the liner (see padding section indicated at 42, for example). The helmet and liner openings 30 and 35, which are in registration, form a venturi operating to accelerate air flow outwardly from the helmet interior (Bernouli effect).

The drawings also show additional rearward facing openings 50 and 60 in the shell medial portion 11*b*, but at lower elevations, and in left and right sides of the shell. Such openings have elements 51 and 61 corresponding to element 31; elements 52 and 62 corresponding to element 32; and elements 53 and 63 corresponding to element 33. Air within the helmet is also aspirated through openings 50 and 60, and channels as at 69 and 70 in the liner (and corresponding to channels 39 and 40) channel air flow toward the openings 50 and 60. The liner has the same opening configuration adjacent openings 50 and 60 as it has at 35 and 36 adjacent opening 30.

Suitable retention means 80, include straps 80*a*–80*c* (connected to the helmet at 84 and 85). Connection 81, and buckle 82 may be provided, as in the case of a bicycle helmet. Such straps may be omitted as in the case of a motorcycle helmet having a lower forwardly jutting, chin protecting section.

Figure 3:
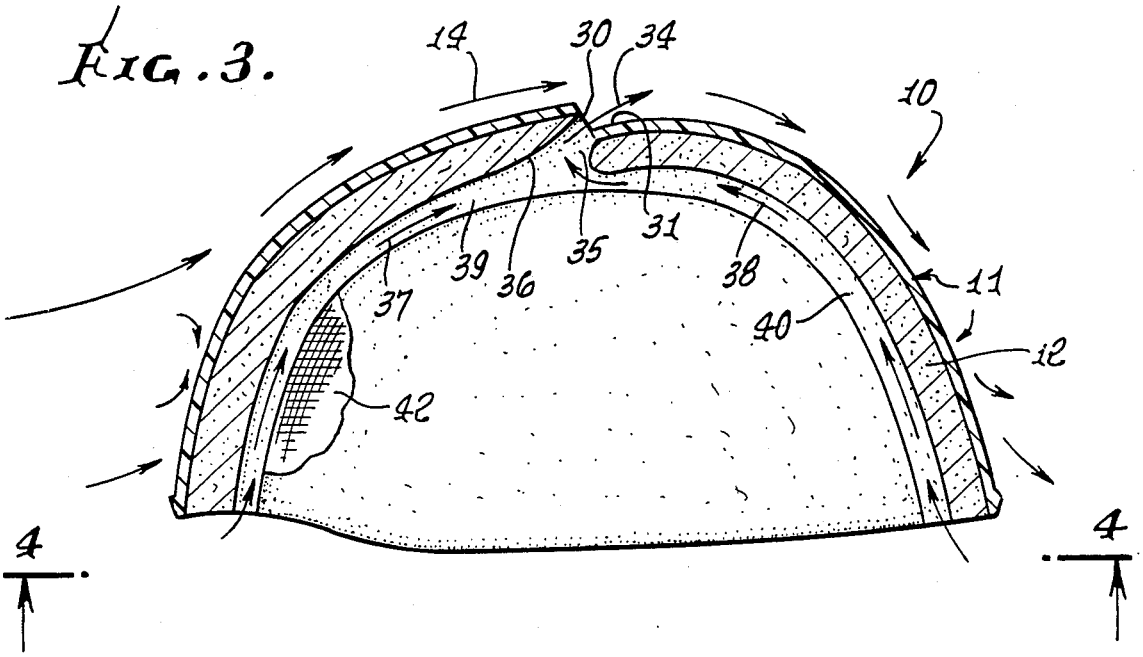
FIG. 3 is a vertical elevation taken in elevation on lines 3—3 of FIG. 2.
Figure 4:
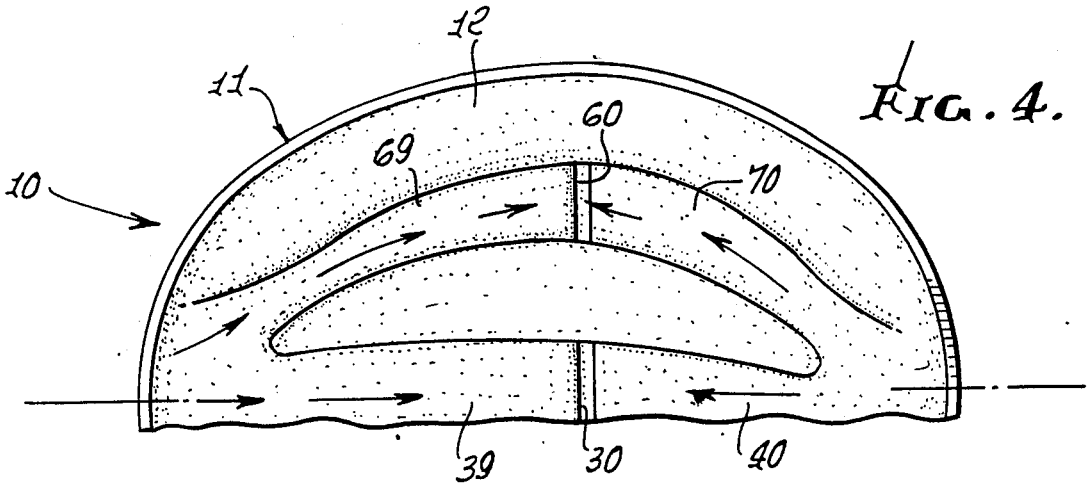
FIG. 4 is a bottom plan view on lines 4—4 of FIG. 3.
Figure 5:
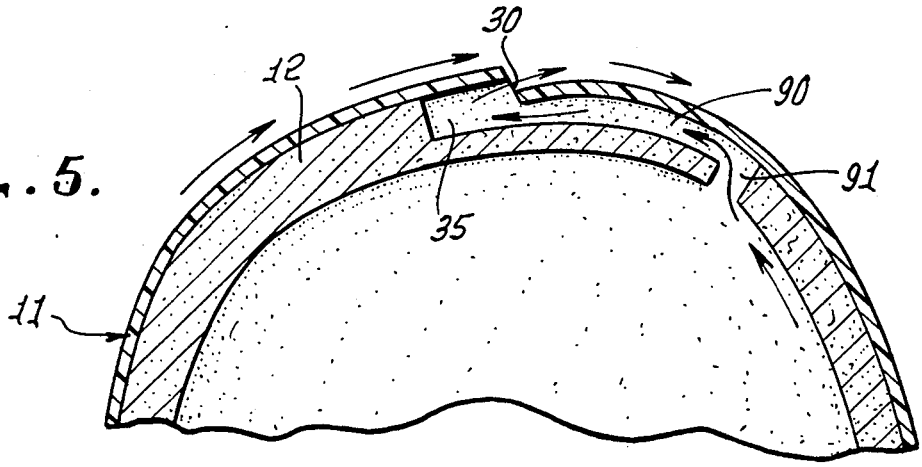
FIGS. 5–7 are vertical sections through modified helmets.
Figure 6:
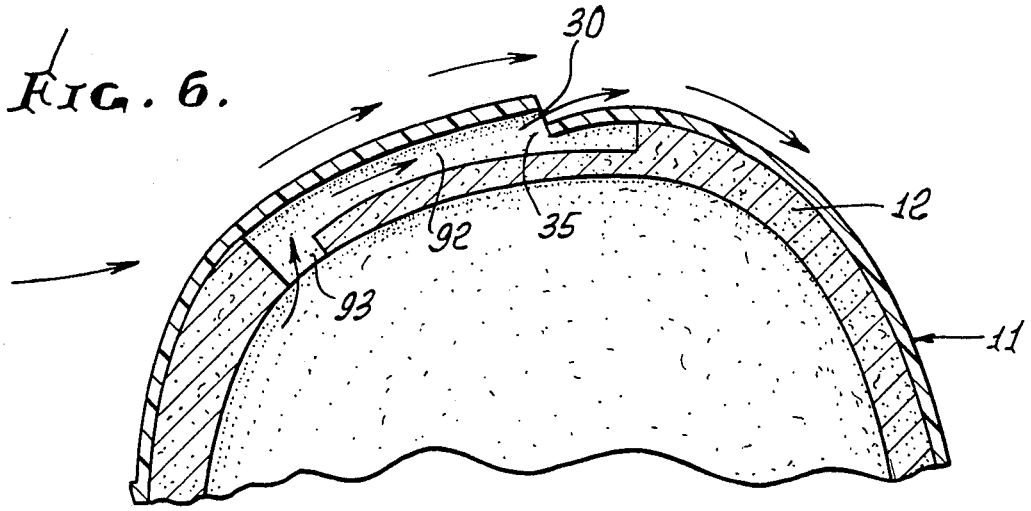

In FIG. 5, the construction is similar to FIG. 3, except that an air flow passage 90 in the liner 12 has an entrance 91 spaced rearwardly from the liner opening 35 that registers with shell rearward facing opening 30. Passage 90 is confined along its length between the liner and shell, and passes air from entrance 90 to openings 35–30. In FIG. 6 the construction is similar to FIG. 3, except that an air flow passage 92 in the liner 12 has an entrance 93 spaced forwardly from the liner opening 35 that registers with shell rearward facing opening 30. Passage 92 is confined along its length between the liner and shell, and passes air from entrance 93 to openings 35 and 30.

Figure 7:
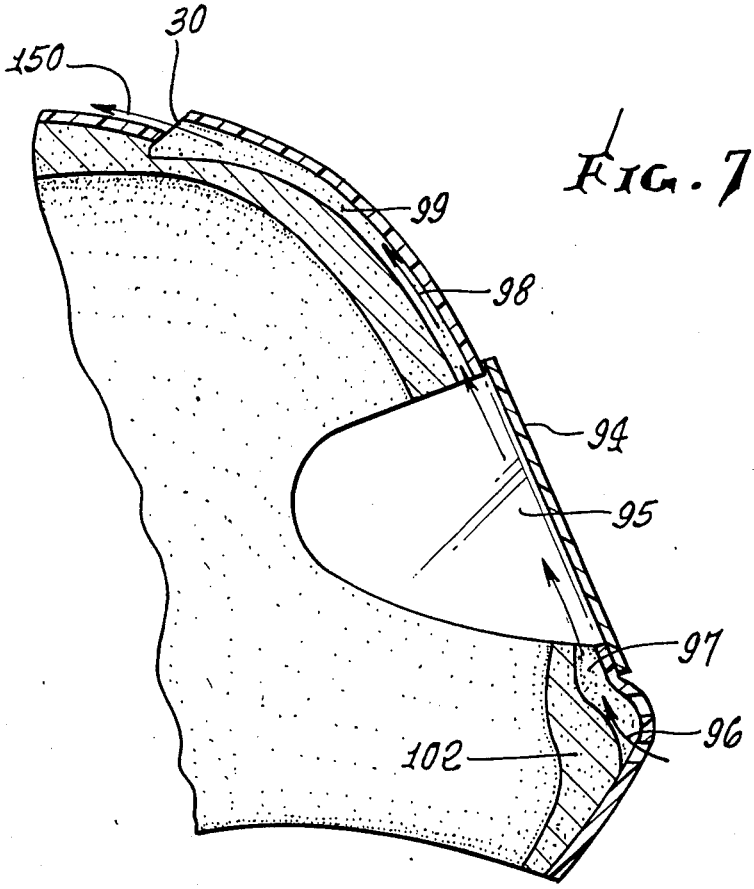

In FIG. 7 the helmet includes a transparent shield 94 extending across a view space 95 at the front of the helmet. The helmet defines air flow passages to deliver air upwardly (see arrows 96 and face piece passage 97) to the lower inside of the shield, and receive air (see arrow 98 and liner passage 99) from the upper inside of the shield for aspiration to the exterior. Thus, for example, air flows at 98 and at 150, to opening 30 in the shell which faces rearwardly, as described above. The face piece is indicated at 102. Full defogging of the shield is thus obtained.

I claim:

1. In a forwardly longitudinally extending cyclist's protective helmet, the combination comprising (a) a dome shaped outer shell having a forward portion, a rearward portion, and a medial portion over which air flows substantially smoothly as the cyclist moves forwardly, said medial portion including an upper crown and laterally spaced left and right sides extending downwardly and laterally from said crown, (b) the outer shell containing at least one opening in said medial portion, said opening facing rearwardly and bounded by elongated outer and inner edges which extend substantially laterally, (c) the shell outer surface being inwardly deflected immediately rearwardly of said inner edge and continuing rearwardly to merge with the dome shape of said outer shell, (d) whereby air flowing over said medial portion acts to aspirate air from within the helmet interior and outwardly through said opening, (e) said medial portion of the helmet located between forward and rearward lateral vertical planes, the forward plane intersecting the helmet surface at an angle $\alpha$ forward of a vertical lateral plane bisecting the helmet, with $\alpha$ measured about an approximate center of forward and rearward curvature of the shell outer top surface, and the rearward plane intersecting the helmet surface at an angle $\beta$ rearward of said vertical lateral plane, with $\beta$ also measured about said center of curvature, $\alpha$ being about 15° and $\beta$ being about 15°.

2. The combination of claim 1 wherein there are at least two of said openings in said shell medial portion.

3. The combination of claim 2 wherein said of each opening edges are generally parallel to form a laterally extending slit therebetween.

4. The combination of claim 2 wherein said openings include a first opening at said upper crown, and additional said openings in said left and right sides of said medial portion and at lower elevations than said one opening.

5. The combination of claim 2 wherein all of said openings face rearwardly and are confined to said medial portion of the helmet defined between said vertical lateral planes.

6. The combination of claim 5 wherein said forward and rearward portions of the shell are continuous and free of vent openings.

7. The combination of claim 2 wherein each of said openings has overall length substantially greater than its width, as measured along the major extent of said length.

8. The combination of claim 2 including a foam plastic liner lining said shell and thicker than the shell, the liner forming rearward facing, laterally elongated openings in registration with said shell openings.

9. The combination of claim 1 including a liner lining the shell and which also forms an opening facing generally rearwardly and in registration with said rearward facing opening in the shell, to pass air to said shell opening, the liner opening also being laterally elongated.

10. The combination of claim 9 wherein said registered liner and shell openings form a venturi operating to accelerate air flow outwardly from the helmet interior 11. The combination claim 9 wherein said liner includes an air flow passage having an entrance forwardly of said opening in the liner, said passage communicating with said opening to pass air from within the helmet to said opening.

12. The combination of claim 1 wherein the helmet includes a transparent shield extending across a view space at the front of the helmet, the helmet defining air flow passages to deliver air upwardly to the lower inside of the shield and to receive air from the upper inside of the shield for aspiration of the exterior.

13. The combination of claim 12 wherein at least one of said air flow passages communicates with said one opening in the outer shell.

14. In a forwardly longitudinally extending cyclist's protective helmet, the combination comprising (a) a dome shaped outer shell having a forward portion, a rearward portion, and a medial portion over which air flows substantially smoothly as the cyclist moves forwardly, said medial portion including an upper crown and laterally spaced left and right sides extending downwardly and laterally from said crown, (b) the outer shell containing at least one opening in said medial portion, said opening facing rearwardly and bounded by elongated outer and inner edges which extend substantially laterally, (c) the shell outer surface being inwardly deflected immediately rearwardly of said inner edge and continuing rearwardly to merge with the dome shape of said outer shell, (d) whereby air flowing over said medial portion acts to aspirate air from within the helmet interior and outwardly through said opening, (e) said medial portion of the helmet being located between two lateral vertical planes respectively spaced about 35% and 75% of the helmet length rearward of the front edge of the helmet.

15. In a forwardly longitudinally extending cyclist's protective helmet, the combination comprising (a) a dome shaped outer shell having a forward portion, a rearward portion, and a medial portion over which air flows substantially smoothly as the cyclist moves forwardly, said medial portion including an upper crown and laterally spaced left and right sides extending downwardly and laterally from said crown, (b) the outer shell containing at least one opening in said medial portion, said opening facing rearwardly and bounded by elongated outer and inner edges which extend substantially laterally, (c) the shell outer surface being inwardly deflected immediately rearwardly of said inner edge and continuing rearwardly to merge with the dome shape of said outer shell, (d) whereby air flowing over said medial portion acts to aspirate air from within the helmet interior and outwardly through said opening, (e) the helmet including a rigid liner lining the inner side of the outer shell, said liner defining air flow channeling extending generally rearwardly toward said one opening and also extending generally forwardly toward said one opening, thereby to channel air to flow within the helmet interior upwardly and rearwardly toward said opening, and upwardly and forwardly toward said opening.

16. In a forwardly longitudinally extending cyclist's protective helmet, the combination comprising (a) a dome shaped outer shell having a forward portion, a rearward portion, and a medial portion over which air flows substantially smoothly as the cyclist moves forwardly, said medial portion including an upper crown and laterally spaced left and right sides extending downwardly and laterally from said crown, (b) the outer shell containing at least one opening in said medial portion, said opening facing rearwardly and bounded by elongated outer and inner edges which extend substantially laterally, (c) the shell outer surface being inwardly deflected immediately rearwardly of said inner edge and continuing rearwardly to merge with the dome shape of said outer shell, (d) whereby air flowing over said medial portion acts to aspirate air from within the helmet interior and outwardly through said opening, (e) and including a liner lining the shell and which also forms an opening facing generally rearwardly and in registration with said rearward facing opening in the shell, to pass air to said shell opening, the liner opening also being laterally elongated, (f) said liner including an air flow passage having an entrance rearwardly of said opening in the liner, said passage communicating with said opening to pass air from within the helmet to said opening.

* * * * *